US010494068B2

(12) United States Patent
Woo

(10) Patent No.: US 10,494,068 B2
(45) Date of Patent: Dec. 3, 2019

(54) VARIABLE-ROCKER SURFBOARD

(71) Applicant: Brenton Mac Woo, San Diego, CA (US)

(72) Inventor: Brenton Mac Woo, San Diego, CA (US)

( * ) Notice: Subject to any disclaimer, the term of this patent is extended or adjusted under 35 U.S.C. 154(b) by 0 days.

(21) Appl. No.: 15/437,126

(22) Filed: Feb. 20, 2017

(65) Prior Publication Data

US 2017/0240253 A1 Aug. 24, 2017

Related U.S. Application Data

(60) Provisional application No. 62/299,443, filed on Feb. 24, 2016.

(51) Int. Cl.
*B63B 35/79* (2006.01)

(52) U.S. Cl.
CPC ..... *B63B 35/7909* (2013.01)

(58) Field of Classification Search
CPC ..... B63B 35/7906; B63B 35/7909; B63B 35/7916
See application file for complete search history.

(56) References Cited

U.S. PATENT DOCUMENTS 3,543,315 A * 12/1970 Hoffman ..... B29C 44/1266 156/79
3,902,207 A 9/1975 Tnkler et al.
3,988,794 A 11/1976 Tinkler et al.
4,209,867 A 7/1980 Abrams, III
4,887,986 A 12/1989 Langenbach
5,114,370 A 5/1992 Moran
5,425,321 A 6/1995 Tinkler
5,489,228 A 1/1996 Richardson et al.
5,944,570 A 8/1999 Appleby
6,131,532 A * 10/2000 Winner ..... B63B 35/7913 114/345
6,900,006 B2 5/2005 Gibson et al.
7,485,022 B2 2/2009 Starr
7,846,000 B2 12/2010 Cox
7,930,985 B2 4/2011 Walworth
(Continued)

OTHER PUBLICATIONS

About Us, https://intsoftboards.com/pages/about-us, FAQs, Q: What are INT softboards made of?, Q: What are the differences between your soft bottom and hard bottom boards?.

*Primary Examiner* — Andrew Polay
(74) *Attorney, Agent, or Firm* — Mu, P.C.

(57) ABSTRACT

The present invention is a variable-rocker surfboard, comprising: a tapered composite panel enveloped partially or entirely in a soft foam. The tapered composite panel is oriented horizontally partially or entirely within the soft foam, such that the length, width, and thickness of the panel correspond with the length, width, and thickness of the soft foam. The objective of this design is to provide a surfboard with desirable flex characteristics that result in variable rocker, wherein the tapered composite core attributes the flex characteristics, and the soft foam provides volume for the desired buoyancy. The present invention may be provided as a surfboard blank, wherein the soft foam needs to be worked into a surfboard shape. The present invention, may also be provided as a surfboard, wherein the soft foam has been shaped to the desired design and may be laminated with an exterior skin.

17 Claims, 8 Drawing Sheets

(56) References Cited

U.S. PATENT DOCUMENTS

| | | | | |
|---|---|---|---|---|
| 7,938,705 | B2 | 5/2011 | Fitzgerald | |
| 8,003,552 | B2 | 8/2011 | Campbell | |
| 8,662,947 | B2 | 3/2014 | Mann | |
| 8,696,397 | B2 | 4/2014 | MacDonald | |
| 9,216,801 | B2 | 12/2015 | Barron | |
| 9,540,079 | B2 | 1/2017 | Wilbur | |
| 2009/0165697 | A1* | 7/2009 | Caldwell | B63B 5/24 114/65 R |
| 2012/0196079 | A1* | 8/2012 | Brauers | B32B 5/18 428/116 |
| 2015/0024644 | A1 | 1/2015 | Hantz | |
| 2017/0096198 | A1* | 4/2017 | Peter | B63B 35/7906 |

* cited by examiner

VARIABLE-ROCKER SURFBOARD

CROSS-REFERENCE TO RELATED APPLICATION(S)

The present application claims priority to U.S. Provisional Patent Application No. 62/299,443 filed on Mar. 24, 2016, entitled "FLEXIBLE SURFBOARDS BY WAY OF HORIZONTALLY LAMINATED SANDWICH PANEL AND SOFT EXTERIOR" the entire disclosure of which is incorporated by reference herein.

BACKGROUND OF THE INVENTION

1. Field of Invention

The present invention relates to the field of surfboards, and more particularly to an improved surfboard with a variable rocker.

2. Description of Related Art

A surfboard's rocker—its longitudinal upwards curvature, measured from its bottom surface—effects that surfboard's balance between speed and maneuverability more than any other design aspect. Less curved (flatter) rocker increases straight-line speed but decreases maneuverability. More curved rocker increases maneuverability but decreases straight-line speed.

This speed and maneuverability trade-off exists because typical surfboards are rigid which means their rockers are fixed shapes. Variable rocker eliminates this trade-off The most common surfboard construction starts with rigid polyurethane (PU) or expanded polystyrene (EPS) foam slabs or "blanks", typically reinforced with one or more stringers for further rigidity. After the foam is sculpted into the desired surfboard design, it is entirely encapsulated in a rigid skin by laminating fiberglass cloth to the foam, typically with polyester or epoxy resin. Because the fiberglass skin serves as a structural component, typical surfboard construction is a monocoque design, which excels at rigidity. Furthermore, typical surfboards are shaped to have features that increase their monocoque rigidity compared to a monocoque without that feature. For example, typical surfboards feature longitudinally convex (domed) deck shapes because laminating the fiberglass to that contour increases the longitudinal rigidity of the fiberglass itself and therefore the board as well.

Because typical surfboard construction emphasizes rigidity, the speed and maneuverability trade-off caused by fixed rockers is considered normal.

The next most common type of surfboard, colloquially called a "soft top", "foamie" or "foam board", is designed with soft exteriors in the interests of user and bystander safety, lower cost, and impact durability. Because their soft exteriors are not structural, soft tops are commonly reinforced for rigidity either internally with stringers or externally such as with a fiberglass layer bonded to their bottom surface, yet still are less rigid than conventional fiberglass monocoque surfboards. Despite a degree of flexibility, soft tops do not deliver variable rocker. Quite the opposite, the flexibility of soft tops typically decreases both speed and maneuverability Soft tops are generally "floppy" meaning they have flexibility without predefined flex patterns, and they lack an ideal rate of "snap back" to their original shape when relieved from flex inducing forces. As such, soft tops tend to push water forward, rather than under the board, making them slow. And their floppy nature means soft tops tend to be less responsive to surfer input and thus are more difficult to maneuver.

Soft top surfboards demonstrate that flexibility alone does not create variable rocker.

The invention delivers variable rocker by giving surfboards a range of flexibility when flex-inducing forces are applied, sufficient snap back to their original shape when flex-inducing forces are relieved, and a flex pattern. When the invention flexes, it doesn't flop or bend in arbitrary ways. The various rocker shapes formed through its range of flexibility are deliberately designed to balance speed and maneuverability for that degree of flex.

SUMMARY OF THE INVENTION

The present invention is a surfboard that flexes to increase rocker while turning for easier maneuverability, and flatten out for less rocker while not turning for easier speed. In the preferred embodiment, the flexible surfboard is comprised of a tapered composite panel disposed partially or entirely into a soft body. The length, width, and thickness of the panel are aligned with the length, width, and thickness of the soft body respectively. The arrangement allows for the tapered composite panel to attribute its flex characteristics to the surfboard, while the soft body provides buoyancy and holds the surfboard's exterior shape.

In an embodiment, the composite panel is provided with a tapered width. In said embodiment, the panel is widest at the center and tapers towards the ends of the panel, such that the ends are the narrowest sections of the panel. In another embodiment, the composite panel may be provided with a tapered thickness. In said embodiment, the panel is thickest at the center and tapers towards the end of the panel, such that the ends are the thinnest sections of the panel. In a preferred embodiment, the panel width will be greater than the panel thickness throughout the length. In an embodiment, the panel is tapered both in width and thickness, such that the ends are both thinner and narrower than the center.

In the preferred embodiment, the soft body will be comprised of a foam. In the embodiment, the foam will preferably be a low-density polyethylene (PE) foam at about 2 pounds per cubic foot (PCF). Furthermore, the foam will have a skin adhered to it to give it increased water-resistance and durability. In a preferred embodiment, the skin will be comprised of a high-density polyethylene foam, about 8 PCF, which will be adhered to the soft body. In the preferred embodiment, low-density PE foam will be shaped to the desired surfboard design prior to the adhesion of the high-density PE skin.

The present invention is further provided with a method of manufacturing which begins with a tapered composite panel. In the preferred embodiment, the soft foam body is provided in two portions, and half of the profile of the panel is cut into each of the foam portions. The panel is then disposed into each of the soft foam portions, and the foam portions are adhered together to create a single soft body with the composite panel disposed within. In a preferred embodiment, the panel will also be coated with an adhesive such that it adheres to the two foam portions.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
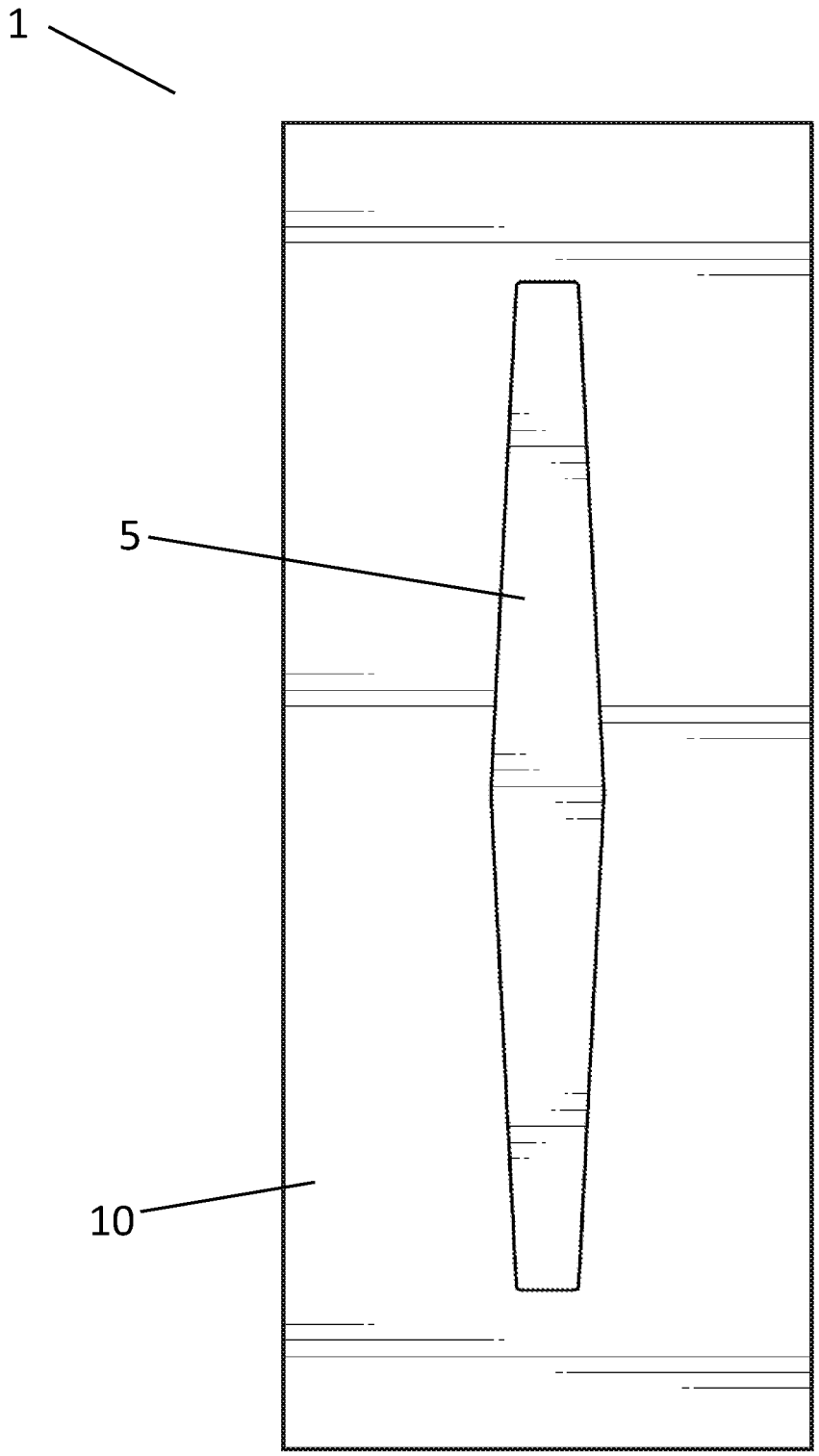
FIG. 1 is a top plan view of the variable-rocker surfboard, according to an embodiment of the present invention.

Preferred embodiments of the present invention and their advantages may be understood by referring to FIGS. 1-8, wherein like reference numerals refer to like elements.

Figure 2:
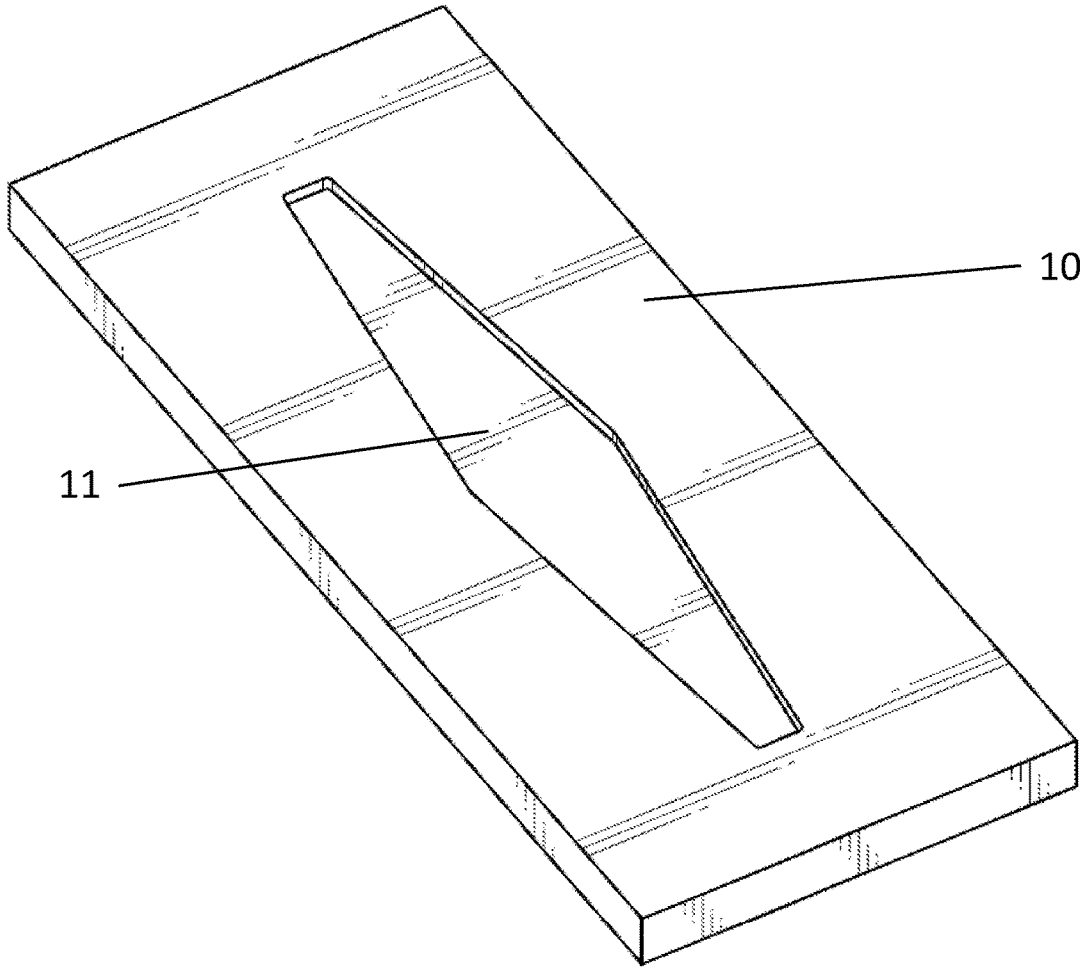
FIG. 2 is a perspective view of the variable-rocker surfboard, according to an embodiment of the present invention.

In reference to FIG. 1-2, an embodiment of the present invention is shown, wherein a surfboard blank 1 is comprised of a tapered composite panel 5 surrounded by a soft body 10. In the embodiment, the soft body 10 is provided with a cutout 11 adapted to retain the panel 5. The panel 5 is adhered into the cutout 11 of a soft body 10. A second soft body piece 10 is then adhered onto the other surface of the panel 5 to create a laminate or surfboard blank which may be shaped into a surfboard design.

In a preferred embodiment, the panel 5 comprised of a rigid core material which is able to flex when a force is applied. The preferred core material for the panel 5 is wood. The wood may be a single piece of wood or a laminated piece comprising of two or more pieces of wood. In a preferred embodiment, a panel comprising of laminated wood may utilize vertical lamination, horizontal lamination, or combination of the two. In the embodiment, the grain of the wood will be aligned with the longitudinal length to provide increased strength over the longitudinal axis. The preferred skin material for the panel 5 is fiberglass, laminated to the core with an epoxy resin. The skin may be fiberglass, another fiber-reinforced cloth such as carbon fiber, Kevlar, or flax, or a solid material such as wood or plastic.

In an embodiment, wherein a wood core is used, the wood used may be paulownia, aspen, beech, birch, bamboo, popular, another wood deemed suitable for the application, or a laminate comprised of multiple wood species. Generally, the wood should be free of knots, holes, and other inconsistencies that may affect the flex and strength of the panel.

In an exemplary embodiment, the panel may be a single plank of paulownia wood with dimensions of 5'×5.25"×0.375" (length×width×thickness). In the embodiment, this panel may be provided for a finished board between the lengths of 5'6 to 6', wherein the panel does not extend all the way through the length of the board. The panel dimensions may be modified appropriately to suit any board length.

In another embodiment, the panel may be comprised of a composite material, polymer, foam, honeycomb, or other material which is mostly rigid, but is also able to flex under an applied force. In an embodiment, the composite panel 5 may be a piece of wood laminated with fiberglass, carbon fiber, Kevlar, aramid, or other fiber-reinforced cloths to provide strengthen and/or stiffen the panel.

In another embodiment, foam, honeycomb or other composite materials may be used in conjunction with or to replace wood to create the core of panel 5. Differing core materials may be used to create a desirable flex pattern in a composite panel. For example, softer core materials may be used where the panel has desired more flex, and stiffer core materials may be used where the panel has desired less flex.

In the preferred embodiment, the panel 5 is tapered to create desirable flex characteristics. Because the panel 5 has less flex (stiffer) where its dimensions are larger, and more flex (softer) where its dimensions are smaller, its flex pattern can be controlled by tapering its width and thickness. In reference to FIG. 1 and FIG. 3, the panel 5 is shown wherein the width of the panel is tapered, such that it narrows from the middle of the panel to the ends. Adjusting flex through width has an approximately linear effect, wherein doubling the width approximately doubles the stiffness.

Figure 5:
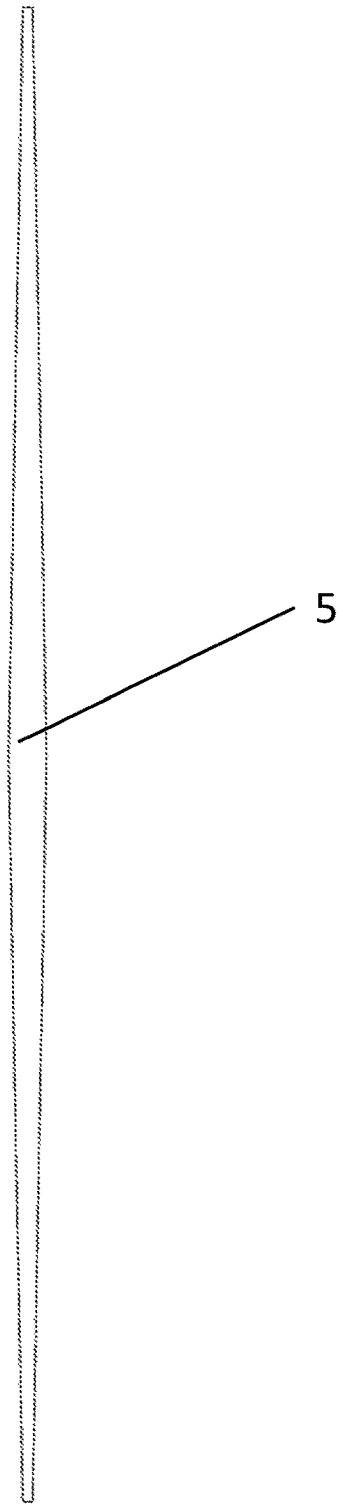
FIG. 5 is left side elevational view of the variable-rocker surfboard, according to an embodiment of the present invention.
Figure 6:
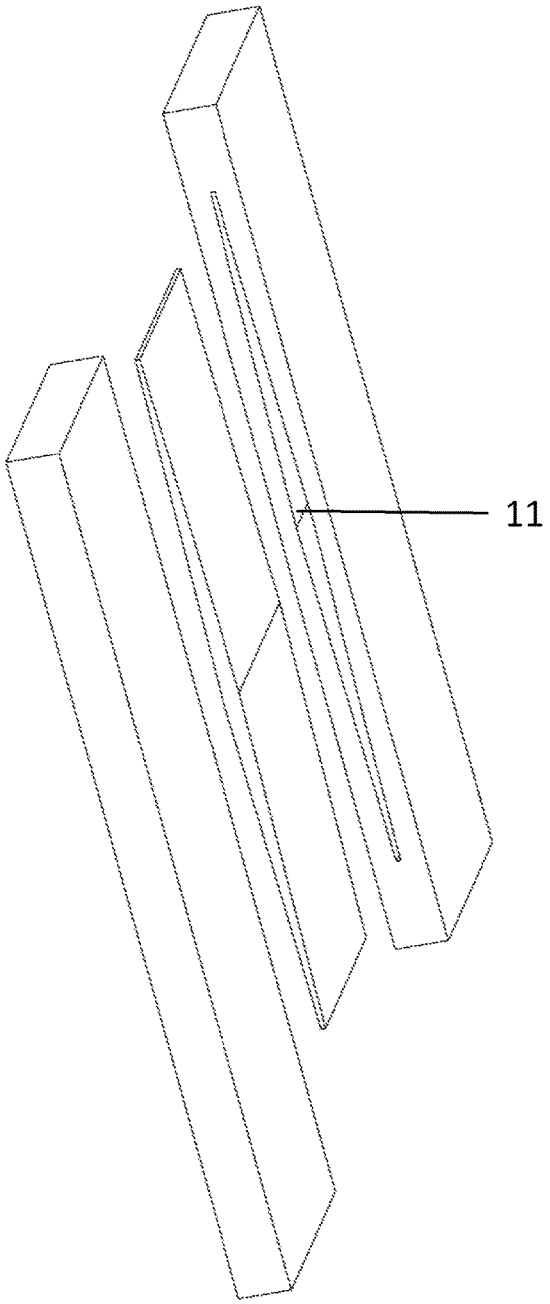
FIG. 6 is a perspective view of the variable-rocker surfboard, according to an embodiment of the present invention.

In another embodiment, as shown in FIGS. 5-6, the panel 5 has a tapered thickness, wherein the panel 5 is thickest at its center and thinnest at its ends. Adjusting flex through thickness has an approximately cubic effect, wherein doubling the thickness increases the stiffness by approximate eight times.

In another embodiment, wherein a fiber-reinforced cloth is used, the cloth may be tapered, layered and overlapped to create a desirable flex pattern. For instance, where increasing flex is desired toward the ends of a panel, the center of the entire length of the panel may be provided with 4 layers of cloth. Then the center can be provided with an additional 2 layers of cloth, such that the center of the panel will be stiffer compared to the ends of the panel.

Figure 3:
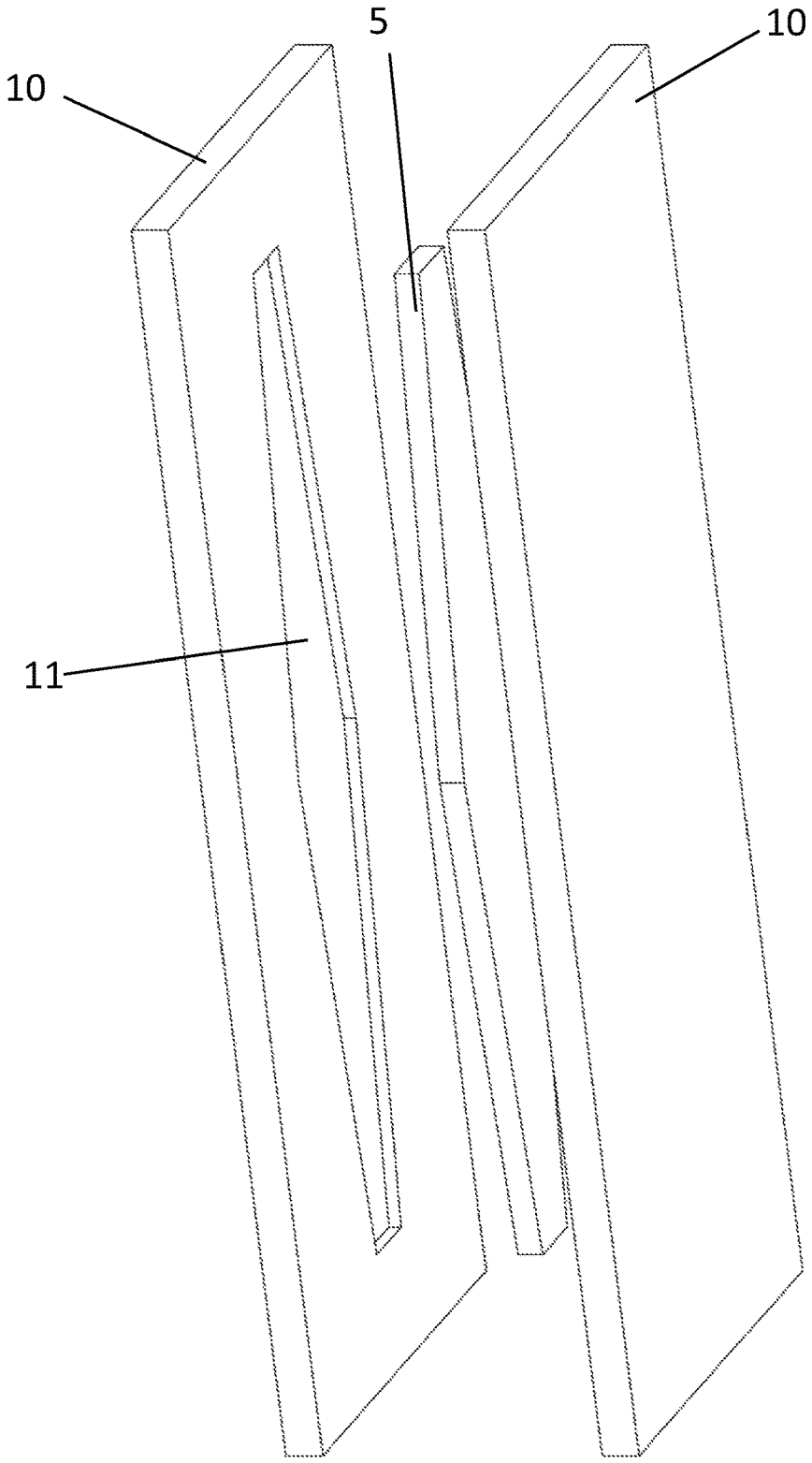
FIG. 3 is a perspective view of the variable-rocker surfboard, according to an embodiment of the present invention.

In reference to FIG. 3, a preferred embodiment of the present invention is shown in an exploded view, wherein the panel 5 of a surfboard blank is laminated between two soft body pieces 10. In the embodiment, each of the soft body pieces 10 is provided with a cutout 11 adapted to fit the panel 5. To create the blank, the panel 5 and the interior faces and cutout 11 of the soft body pieces 10 are coated with adhesive. The panel 5 is fit into the cutouts 11 of the body pieces 10, and the components are pressed together as the adhesive cures. This process creates a laminated sandwich, wherein the panel 5 is completely or partially enveloped by the soft body pieces 10 to form the preferred surfboard blank.

Figure 4:
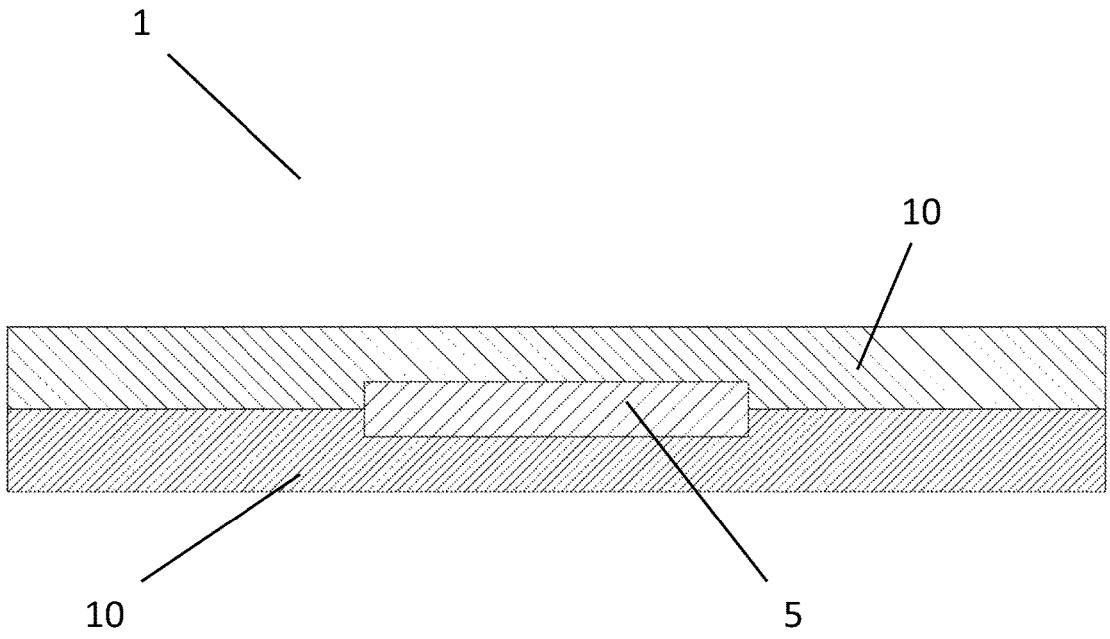
FIG. 4 is a sectional view of the variable-rocker surfboard, according to an embodiment of the present invention.

In reference to FIG. 4, a cross-section of the surfboard blank 1 is shown wherein the panel 5 is laminated between two soft body pieces 10. The laminate is arranged in a vertical orientation, wherein the body pieces 10 are set onto the top and bottom surfaces of the panel. The arrangement provides a surfboard blank 1 wherein the panel 5 is completely enveloped by the soft body portions 10.

In reference to FIG. 5, a panel 5 is shown having a tapering thickness, wherein the panel is thickest in the center of its length and thinnest at its ends. In reference to FIG. 6, the panel 5 is shown between two soft body pieces 10, wherein each of the soft body pieces is provided with a cutout 11 adapted to fit one half of the panel. In the embodiment, the panel 5 and interior faces of the soft body pieces will be coated with adhesive and fit together. This will completely envelope the panel 5 within the two soft body pieces.

Figure 7:
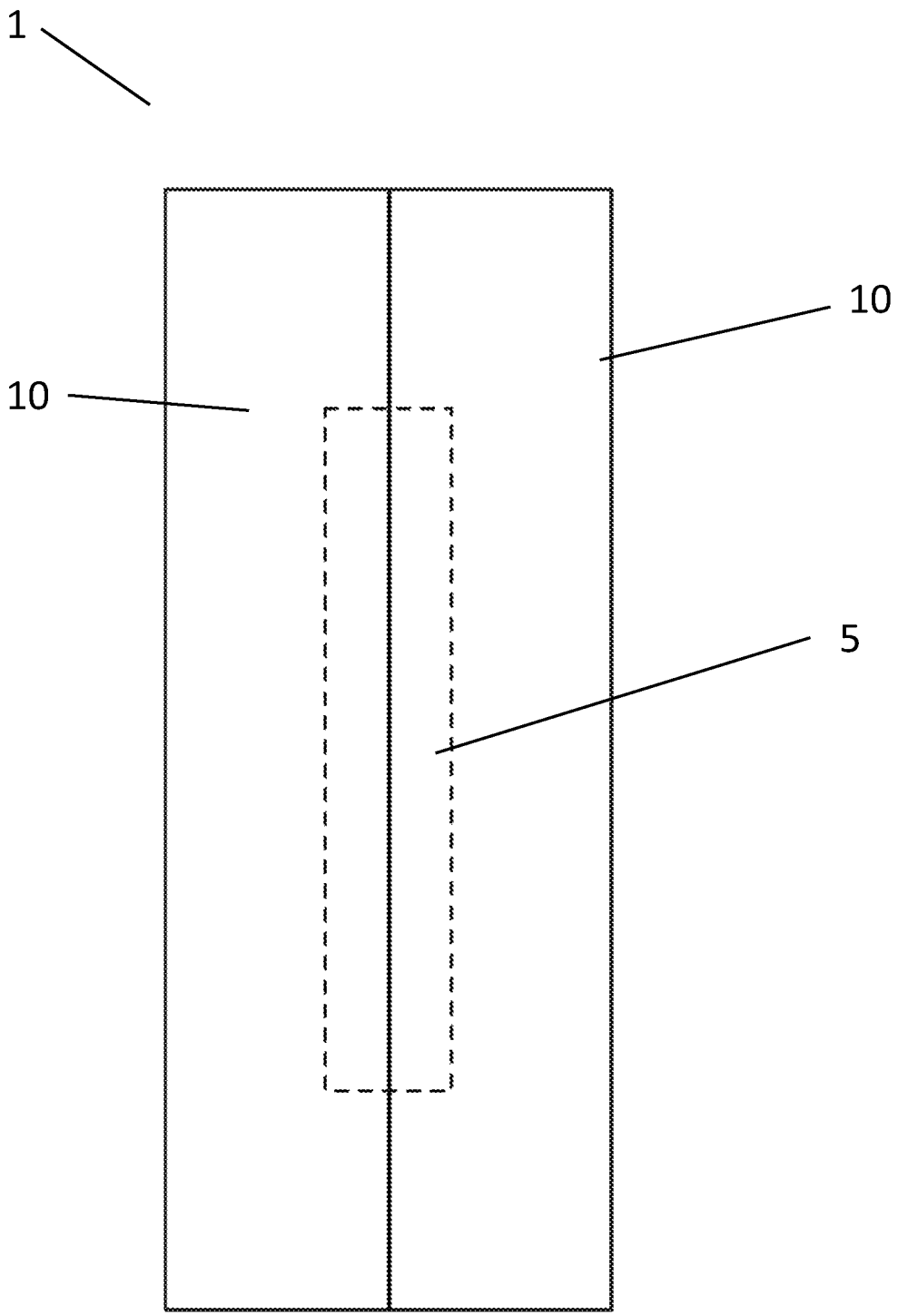
FIG. 7 is a top plan view of the variable-rocker surfboard, according to an embodiment of the present invention.

In reference to FIG. 7, a completed surfboard blank 1 is shown, according to an embodiment of the present invention. In the embodiment shown, the panel 5 has been enveloped by soft body piece 10 provided on the left side, and a soft body piece 10 provided on the right side. The components have been adhered, and in some embodiments a glue line 12 may be visible where the two exterior pieces are adhered together.

In the preferred embodiment, the soft body 10 of the surfboard blank 1 is comprised of a low density, soft, and flexible material. The soft body 10 is preferable comprised of polyethylene (PE) foam with a density of approximately 2 pounds per cubic foot (PCF), but may also be comprised of arcel, polypropylene, polyurethane, polystyrene, a blend of these, or other materials deemed suitable for the application.

In an embodiment, the soft body portions of surfboard blank 1, will then be shaped into a surfboard design. The blank can be shaped with hand tools, power tools, or by a computer numeric controlled (CNC) cutting machine. In a preferred embodiment, after being shaped the blank is laminated with a high-density skin. In the preferred embodiment, the high-density skin is comprised of PE foam of approximately 8 PCF, however, other common skin materials such as ethylene vinyl acetate (EVA) and polyvinyl chloride (PVC) may be used. The high-density skin may be hand laminated to the shaped blank, vacuum bagged, or heat-bonded. The excess skin is then trimmed off or sanded away to bring the blank back to its desired shape.

In the preferred embodiment, the soft body 10 and high-density skin will have relatively little rigidity or elasticity on their own. The objective, is that the created surfboard blank 1, will have flex characteristics which are primarily dependent on the panel 5.

Figure 8:
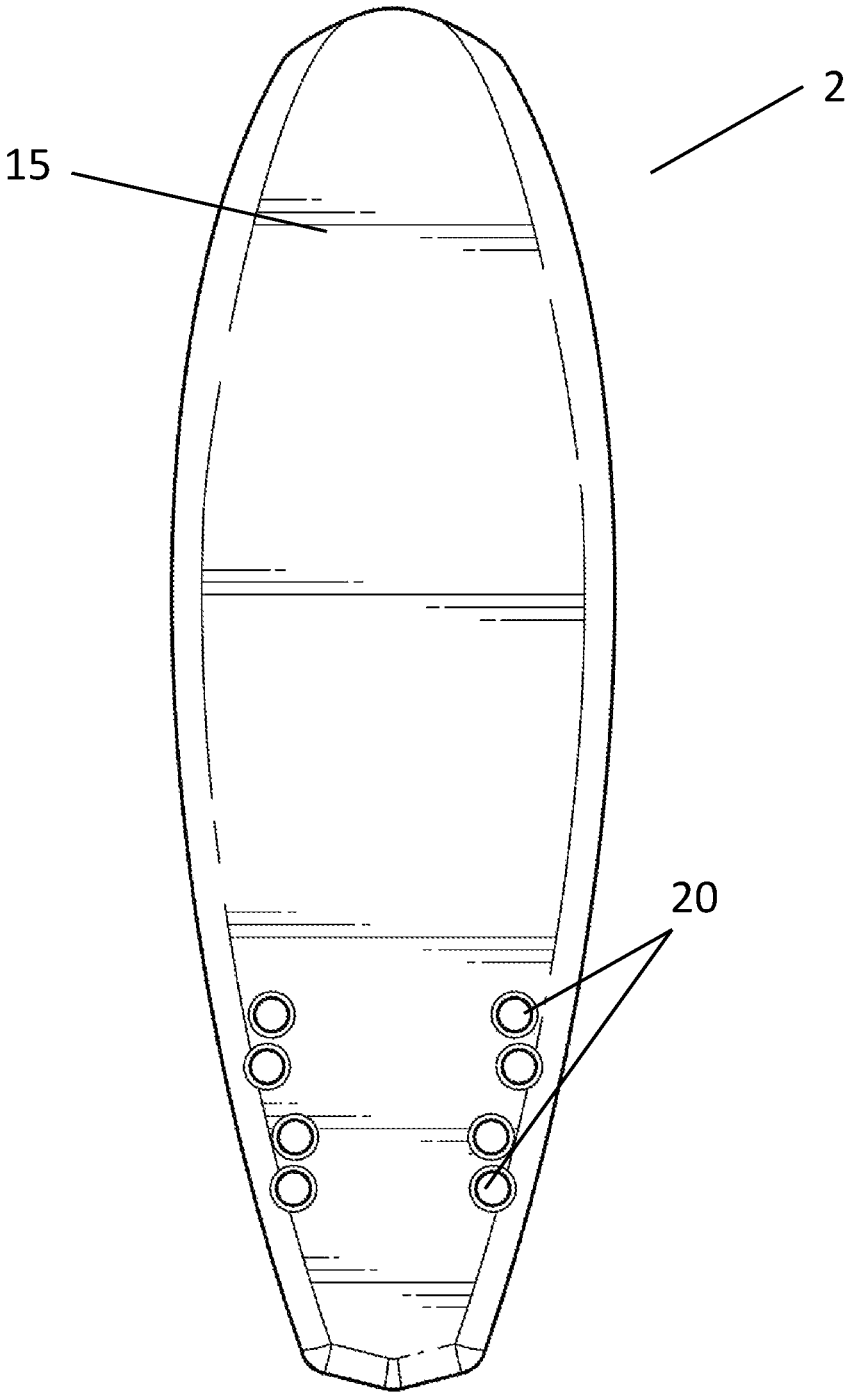
FIG. 8 is a top plan view of the variable-rocker surfboard, according to an embodiment of the present invention.

In reference to FIG. 8, a finished surfboard 2 is shown, according to an embodiment of the present invention. In the embodiment, the finished surfboard 2 is provided with a high-density skin 15. Furthermore, the surfboard 2 has been provided with a fin system 20 so a user may use removable fins with the surfboard. In another embodiment, the surfboard 2 will be further provided with a plug to attach a leash to (not shown) and an extra, thin skin layer (not shown) provided on the bottom surface, and preferably comprised of a PVC as is known in the art.

The ideal result of the flexible panel is that in straight-line travel, its flex enables the length of the surfboard to be relatively flat against the dynamic surface of the wave beneath it for maximum speed. In cornering, the surfer's weight and feet position against the surfboard's area of water contact flexes the length of the surfboard to increase its rocker for better maneuverability. Under normal circumstances, the board embodiments described herein have less (flatter) rocker than typical surfboards which allow for increased maximum straight-line speed. Since cornering forces operate relative to how hard a surfer turns, flex increases rocker to the degree needed to match the arc of the surfer's intended turn.

In another embodiment of the present invention, the panel 5 may be constructed with a degree of upward longitudinal curvature before it is disposed partially or entirely into soft body. The curvature may be designed to correspond with a final surfboard shape in order to, for example, reduce the effort or time required to work the soft body into that surfboard's shape. The curvature may also serve to help the surfboard's nose remain above the surface of the water while riding a wave.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A flexible surfboard having:

a. a foam body having a length, width, and thickness; and b. a tapered composite panel disposed within the foam body, the tapered composite panel having a length, width, thickness, and configured to flex under induced forces during use, wherein the flex characteristics of the flexible surfboard are primarily dependent on flex characteristics of the tapered composite panel, and wherein the tapered composite panel is oriented within the foam body such that the length, width, and thickness of the tapered composite panel align with the length, width, and thickness of the foam body, respectively, wherein the thickness of the soft body is less than the width than the soft body, and the width of the soft body is less than the length of the soft body, and wherein the thickness of the tapered composite panel is less than the width than the tapered composite panel, and the width of the tapered composite panel is less than the length of the tapered composite panel, wherein the length of the tapered composite panel is 6 to 12 inches shorter than the length of the foam body.

2. The flexible surfboard of claim 1, wherein the tapered composite panel width is narrowest at the ends and widest at the center.

3. The flexible surfboard of claim 1, wherein the tapered composite panel is thickest at its center and thinnest at the ends.

4. The flexible surfboard of claim 1, wherein the tapered composite panel width is greater than the panel thickness.

5. The flexible surfboard of claim 1, wherein the tapered composite panel core is comprised of wood.

6. The flexible surfboard of claim 1, wherein the tapered composite panel core is comprised of a composite material.

7. The flexible surfboard of claim 1, wherein the soft body is comprised of polyurethane or expanded polystyrene foam.

8. The flexible surfboard of claim 1, wherein the foam body is comprised of a low-density polyethylene foam.

9. The flexible surfboard of claim 1, further comprising a skin to be adhered to the foam body.

10. The flexible surfboard of claim 9, wherein the skin is a high-density polyethylene foam.

11. A method of making a flexible surfboard comprising:

providing a foam body having a length, a width, and a thickness disposing a tapered composite panel within the foam body, the tapered composite panel having a length, width, thickness, and configured to flex under induced forces during use; and orienting the tapered within the foam body such that the length, width, and thickness of the tapered composite panel align with the length, width, and thickness of the foam body, respectively;

wherein the flex characteristics of the flexible surfboard are primarily dependent on flex characteristics of the tapered composite panel, wherein the thickness of the soft body is less than the width than the soft body, and the width of the soft body is less than the length of the soft body, and wherein the thickness of the tapered composite panel is less than the width than the tapered composite panel, and the width of the tapered composite panel is less than the length of the tapered composite panel, wherein the length of the tapered composite is 6 to 12 inches shorter than the length of the foam body.

12. The method of making the flexible surfboard of claim 11, further comprising a step to shape the foam body into a surfboard design.

13. The method of making the flexible surfboard of claim 11, further comprising a step to adhere a skin to the surfboard design.

14. The method of making the flexible surfboard of claim 13, wherein the skin is comprised of a high-density polyethylene foam.

15. The method of making the flexible surfboard of claim 11, wherein the tapered composite panel is adhered to the foam body.

16. The flexible surfboard of claim 1, wherein a ratio of length to width to thickness, of the tapered composite panel is approximately 160:14:1.

17. The flexible surfboard of claim 16, wherein the width is measured at a widest point of the tapered composite panel, orthogonal to the length and the thickness, and wherein the thickness is measured at a thickest point of the tapered composite panel, orthogonal to the length and width.

* * * * *